US008145077B2

(12) United States Patent
Miyauchi

(10) Patent No.: US 8,145,077 B2
(45) Date of Patent: Mar. 27, 2012

(54) IMAGE FORMING APPARATUS AND PAPER-JAM CLEARING METHOD

(75) Inventor: Shigeto Miyauchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 568 days.

(21) Appl. No.: 12/397,463

(22) Filed: Mar. 4, 2009

(65) Prior Publication Data

US 2009/0232523 A1 Sep. 17, 2009

(30) Foreign Application Priority Data

Mar. 17, 2008 (JP) ..... 2008-068434

(51) Int. Cl.
*G03G 15/00* (2006.01)
*B65H 7/02* (2006.01)

(52) U.S. Cl. ..... 399/21; 399/18; 399/20; 271/259; 271/265.02; 271/303

(58) Field of Classification Search ..... 399/18, 399/19, 20, 21; 271/256, 258.01, 258.02, 271/258.04, 259
See application file for complete search history.

(56) References Cited

U.S. PATENT DOCUMENTS

| | | | | |
|---|---|---|---|---|
| 4,750,020 | A * | 6/1988 | Ishizu et al. | 399/20 |
| 5,532,793 | A * | 7/1996 | Kogure | 399/19 |
| 5,580,046 | A * | 12/1996 | Beaufort et al. | 271/3.16 |
| 7,334,786 | B2 * | 2/2008 | Shinga | 271/9.11 |
| 7,382,472 | B2 * | 6/2008 | Wada | 358/1.1 |
| 2009/0041485 | A1 * | 2/2009 | Shoji et al. | 399/43 |

FOREIGN PATENT DOCUMENTS

JP 2000-62985 2/2000

* cited by examiner

*Primary Examiner* — Judy Nguyen
*Assistant Examiner* — Justin Olamit
(74) *Attorney, Agent, or Firm* — Dickstein Shapiro LLP

(57) ABSTRACT

A paper conveying path extends from a paper feeding tray to an image forming unit, a branch conveying path extends from a branching point in the paper conveying path to a paper container, a first paper sensor and a second paper sensor are arranged in the paper conveying path upstream of the branching point, and a switch nail is arranged at the branching point to switch paths between the paper conveying path and the branch conveying path. The switch nail is controlled so that a jammed paper is conveyed to the paper container via the branch conveying path upon detecting paper jamming in the paper conveying path and the first sensor detects the jammed paper while the second sensor does not detect the jammed paper.

12 Claims, 4 Drawing Sheets

IMAGE FORMING APPARATUS AND PAPER-JAM CLEARING METHOD

CROSS-REFERENCE TO RELATED APPLICATIONS

The present application claims priority to and incorporates by reference the entire contents of Japanese priority document 2008-068434 filed in Japan on Mar. 17, 2008.

BACKGROUND OF THE INVENTION

1. Field of the Invention

The present invention relates to technology for clearing a jammed paper in an image forming apparatus.

2. Description of the Related Art

For example, Japanese Patent Application Laid-open No. 2000-062985 discloses an image forming apparatus that includes a plurality of paper feeding trays that has a series of paper conveying paths extending to the apparatus body, a locking mechanism that locks each of the paper feeding trays, and a control unit that controls locking operation of the locking mechanism. Each of the paper feeding trays is provided with a paper feeding unit that feeds paper to the apparatus body, and an operation detecting unit that detects the start of paper feeding by the paper feeding unit. When any one of the operation detecting units detects the start of paper feeding by a paper feeding unit, the locking mechanism locks a paper feeding tray from which paper feeding is started, and all other paper feeding trays arranged on the upper position than the paper feeding tray. When a paper feeding tray is locked, it cannot be pulled out of the apparatus body. When a paper jam is detected, a lock set by the locking mechanism is released so as to permit pulling out of a paper feeding tray from the apparatus body.

By locking paper feeding trays with the locking mechanism, it is possible to prevent a trouble, for example, jamming caused by breaking of a paper conveying path resulting from pulling out (withdrawing) a paper feeding tray in the paper conveying path. However, a possibility has not been considered that a sheet of paper inside the apparatus is stopped on the way between a paper feeding tray and the apparatus body when jamming occurs and the apparatus halts.

If a sheet of paper is stopped on the way between a paper feeding tray and the apparatus body, a tray lock is released. As a result, if a user pulls out the paper feeding tray in a fluster while the sheet of paper is stopped, the sheet of paper inside the apparatus is broken, and a residual piece of paper may be disadvantageously left inside the apparatus.

SUMMARY OF THE INVENTION

It is an object of the present invention to at least partially solve the problems in the conventional technology.

According to an aspect of the present invention, there is provided an image forming apparatus including a body; a paper feeding tray provided in a detachable manner in the body for stacking paper; an image forming unit that performs image forming on a paper and that is arranged in the body; a paper conveying path that extends from the paper feeding tray to an image forming unit and feeds a paper from the paper feeding tray to the image forming unit; a paper container for stacking a paper; a branch conveying path that extends from a branching point in the paper conveying path to the paper container; a first paper sensor that is arranged in the paper conveying path downstream of the paper feeding tray and upstream of the branching point and detects a paper passing through the paper conveying path; a second paper sensor that is arranged in the paper conveying path downstream of the first paper sensor and upstream of the branching point and detects a paper passing through the paper conveying path; a switch nail that is arranged at the branching point and configured to switch conveyance paths of a paper between the paper conveying path and the branch conveying path; a jam detecting unit that detects paper jamming on the paper conveying path; and a switch control unit that controls the switch nail so that a jammed paper is conveyed to the paper container via the branch conveying path when the jam detecting unit detects paper jamming and the first sensor detects the jammed paper while the second sensor does not detect the jammed paper.

According to another aspect of the present invention, there is provided a paper-jam clearing method implemented in an image forming apparatus that includes a body; a paper feeding tray provided in a detachable manner in the body for stacking paper; an image forming unit that performs image forming on a paper and that is arranged in the body; a paper conveying path that extends from the paper feeding tray to an image forming unit and feeds a paper from the paper feeding tray to the image forming unit; a paper container for stacking a paper; a branch conveying path that extends from a branching point in the paper conveying path to the paper container; a first paper sensor that is arranged in the paper conveying path downstream of the paper feeding tray and upstream of the branching point and detects a paper passing through the paper conveying path; a second paper sensor that is arranged in the paper conveying path downstream of the first paper sensor and upstream of the branching point and detects a paper passing through the paper conveying path; a switch nail that is arranged at the branching point and configured to switch conveyance paths of a paper between the paper conveying path and the branch conveying path; and a jam detecting unit that detects paper jamming on the paper conveying path. The paper-jam clearing method includes controlling the switch nail so that a jammed paper is conveyed to the paper container via the branch conveying path when the jam detecting unit detects paper jamming and the first sensor detects the jammed paper while the second sensor does not detect the jammed paper.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention will be explained below in detail with reference to the accompanying drawings.

Figure 1:
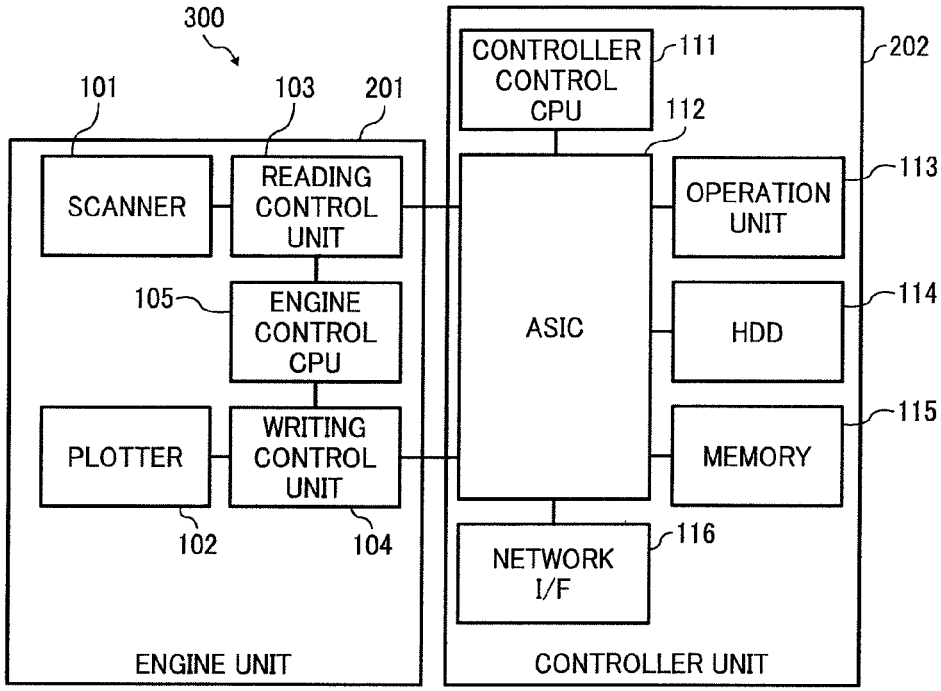
FIG. 1 is a functional block diagram of a configuration of a control system of an image forming apparatus according to an embodiment of the present invention.

First of all, a configuration example of a control system of an image forming apparatus 300 according to an embodiment of the present invention is explained below with reference to FIG. 1.

The image forming apparatus 300 is a multi-function peripheral (MFP), and includes an engine unit 201 and a controller unit 202 (image processing device). Another image forming apparatus, such as a laser printer, a digital photocopier, or a facsimile device, can be used instead of an MFP.

The engine unit 201 includes a scanner 101, the plotter 102, a reading control unit 103, a writing control unit 104, and an engine control central processing unit (CPU) 105. The engine unit 201 corresponds to an apparatus body.

The scanner 101 is an image reading unit that reads (scans) originals.

The plotter 102 includes an image forming unit (not shown) and a fixing unit (not shown). The image forming unit receives image data developed on a memory 115 of the controller unit 202 via an application specific integrated circuit (ASIC) 112 and the writing control unit 104, and prints (forms) a toner image as a visible image onto printing paper (or other recording materials). The fixing unit fixes, by heat and/or pressure, the toner image to the printing paper.

The image forming unit is equipped with an optical writing device, which can outputs laser beams of, for example, four color process of Y (yellow), M (magenta), C (cyan), and B (black).

Writing of an image with a laser beam from the optical writing device inside the image forming unit is already known, therefore, details are omitted.

The reading control unit 103 controls reading of an original image performed by the scanner 101.

The writing control unit 104 is a writing control unit (writing control device) that controls the optical writing device inside the image forming unit included in the plotter 102.

The engine control CPU 105 controls each unit of the engine unit 201 by operating in accordance with a computer program in a not-shown read-only memory (ROM).

The controller unit 202 includes a controller control CPU 111, the ASIC 112, an operation unit 113, a hard disk drive (HDD) 114, the memory 115, and a network interface (I/F) 116. The operation unit 113 is arranged outside the controller unit 202 in practice.

The controller control CPU 111 controls each unit of the controller unit 202 by operating in accordance with a fixed computer program inside the not-shown ROM, and a computer program developed on the memory 115.

The ASIC 112 is a multi-functional device board, provides sharing of a device to be controlled by the controller control CPU 111, and assists in increasing the efficiency of development of an application program in terms of architecture.

The operation unit 113 includes various operation keys (i.e., operation switches or operation buttons) for receiving input of data, such as an operation instruction to the engine unit 201 based on a selection of an image processing function provided by the image forming apparatus, a display device, such as a liquid crystal display (LCD) or a cathode ray tube (CRT), and a pilot lamp.

The HDD 114 is a nonvolatile storage unit (storage device) that can store therein a large amount of data, and can store therein computer programs including an operating system (OS), and various data, such as various setting data, and image data. The HDD 114 can store therein data present in the memory 115. Moreover, the controller unit 202 can be configured to include a nonvolatile memory, and to store therein various setting data.

The memory 115 is a storage unit, such as a random access memory (RAM), to be used as, for example, a program memory that stores therein various computer programs, a working memory to be used by the controller control CPU 111 when performing data processing, and an image memory on which image data is to be developed.

The network I/F 116 is provided for communicating with an external device, such as a personal computer, via a not-shown network.

Image data to be printed vary, for example, data read from the scanner 101(image data in red-green-blue (RGB)), data input from the network I/F 116, or stored data in the HDD 114. When performing a printing operation, color (full-color) data is preliminarily converted into image data in each color of YMCB, and monochrome data is preliminarily converted into monochrome (gray scale) image data, and then converted data is developed on the memory 115.

When the power of the image forming apparatus 300 is turned on, the controller control CPU 111 reads various computer programs including an operating system (OS) and application software stored in the HDD 114 in accordance with a boot program in the ROM; develops the read programs on the memory 115; then operates in accordance with each program (selectively executes each program as required); and controls the apparatus, thereby implementing functions relevant to the embodiment of the present invention as a jam detecting unit, a conveyance control unit, a warning-indication control unit, and a tray-lock control unit.

Figure 2:
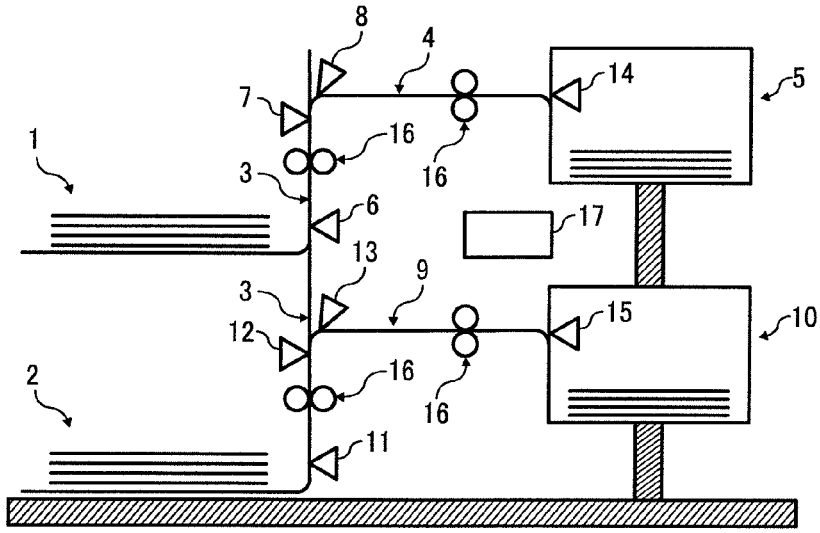
FIG. 2 is a schematic diagram that depicts a configuration example of relevant parts of a plotter shown in FIG. 1.

A configuration example of relevant parts of the plotter 102 is explained below with reference to FIG. 2.

The plotter 102 includes paper feeding trays 1 and 2 for feeding printing paper, each of which is provided in a detachable manner.

Moreover, the plotter 102 includes a jammed-paper stock box 5, a border sensor (first sensor) 6, a branch sensor (second sensor) 7, a switch nail 8, and a box paper-discharge sensor 14. The jammed-paper stock box 5 is arranged on the side of a branch conveying path 4 that is branched from a paper conveying path 3 extending from the paper feeding tray 1 to the image forming unit, and stocks printing paper that is jammed on the paper conveying path 3. The border sensor 6 is arranged on the border between the paper feeding tray 1 and the image forming unit on the paper conveying path 3, and detects printing paper. The branch sensor 7 is arranged at a branch point to the branch conveying path 4 downstream from the border sensor 6 on the paper conveying path 3, and detects printing paper. The switch nail 8 is arranged also at the branch point, and configured to switch printing paper to delivery to the jammed-paper stock box 5 on the side of the branch conveying path 4. The box paper-discharge sensor 14 is arranged in the vicinity of an outlet to the jammed-paper stock box 5.

Furthermore, the plotter 102 includes a jammed-paper stock box 10, a border sensor 11, a branch sensor 12, a switch nail 13, and a box paper-discharge sensor 15. The jammed-paper stock box 10 is arranged on the side of a branch conveying path 9 that is branched from the paper conveying path 3 extending from the paper feeding tray 2 to the image forming unit, and stocks printing paper that is jammed on the paper conveying path 3. The border sensor 11 is arranged on the border between the paper feeding tray 2 and the image forming unit on the paper conveying path 3, and detects printing paper. The branch sensor 12 is arranged at a branch point to the branch conveying path 9 downstream from the border sensor 11 on the paper conveying path 3, and detects printing paper. The switch nail 13 is arranged also at the branch point, and configured to switch printing paper to delivery to the jammed-paper stock box 10 on the side of the branch conveying path 9. The box paper-discharge sensor 15 is arranged in the vicinity of an outlet to the jammed-paper stock box 10.

Moreover, the plotter 102 includes a plurality of box paper-discharge rollers 16 and a box paper-discharge motor 17. The box paper-discharge rollers 16 are configured to discharge printing paper conveyed from the paper conveying path 3 to the branch conveying path 4 into the jammed-paper stock box 5. The box paper-discharge motor 17 rotationally drives each of the box paper-discharge rollers 16. The box paper-discharge rollers 16 also have a function as conveying rollers for conveying printing paper that is fed from the paper feeding tray 1 or the paper feeding tray 2 to the image forming unit via the paper conveying path 3 in practice. Furthermore, the plotter 102 includes paper feeding rollers, which are not shown, for feeding printing paper from the paper feeding tray 1 or the paper feeding tray 2.

Moreover, it is assumed that the plotter 102 includes a tray locking mechanism (tray locking unit), which is not shown, configured to lock each of the paper feeding tray 1 and the paper feeding tray 2 to secure them not to be pulled out of the apparatus body. The tray locking mechanism is described in detail, for example, in Japanese Patent Application Laid-open No. 2000-062985.

Examples of operation relevant to the embodiment of the present invention performed by the control units of the image forming apparatus when jamming occurs are explained below with reference to FIGS. 3, 4A to 4E, and FIG. 5A to 5F. Although the operation can be performed when feeding paper from any of the paper feeding tray 1 and the paper feeding tray 2, only a case of feeding paper from the paper feeding tray 1 is explained below for convenience of explanation.

Figure 3:
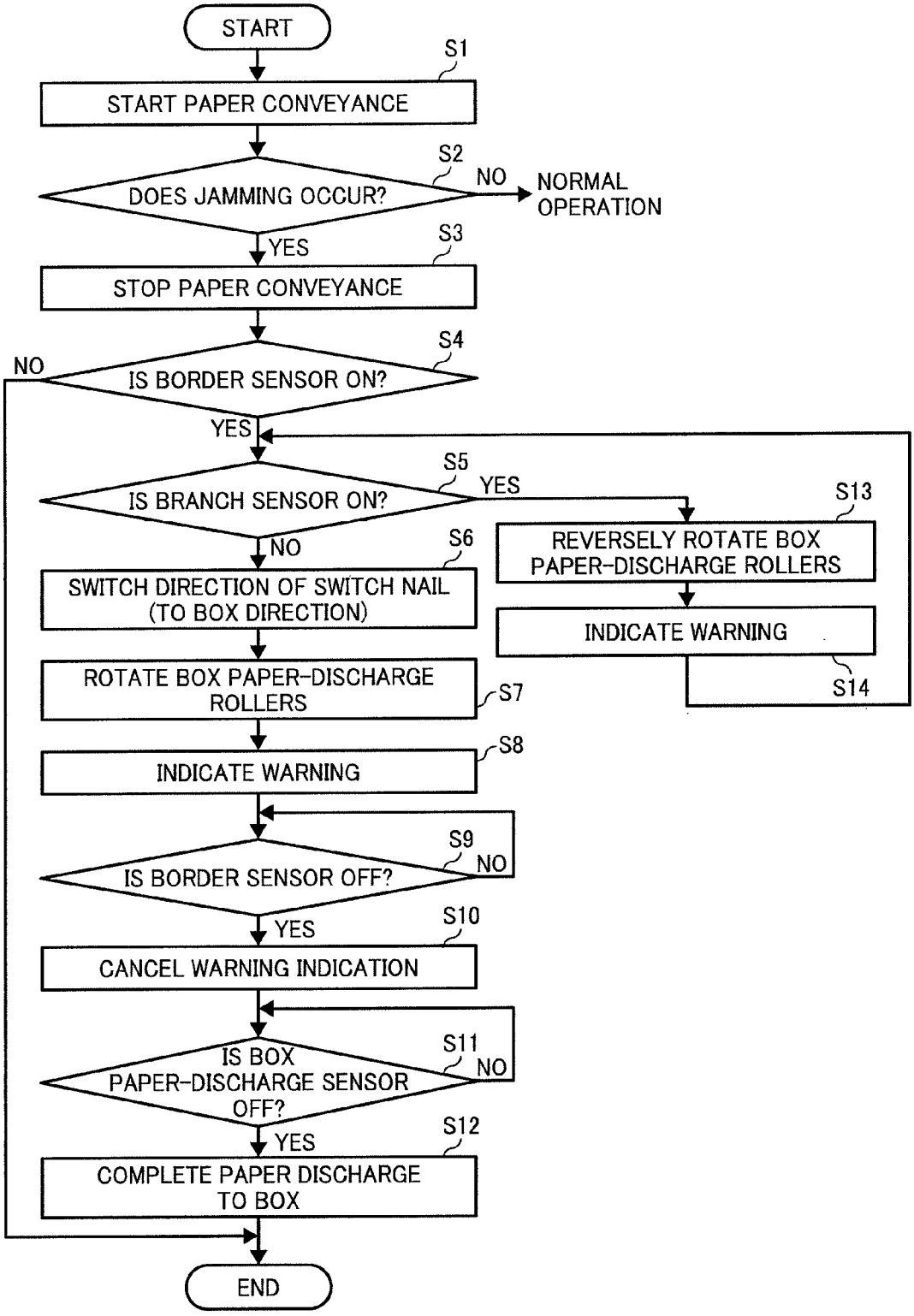
FIG. 3 is a flowchart of an example of series of operations performed by various units of the image forming apparatus shown in FIG. 1.

To print an image onto printing paper with the image forming unit, the control units of the image forming apparatus 300 (including the controller control CPU 111 shown in FIG. 1) start operation shown in FIG. 3 with certain timing. To begin with, conveyance of printing paper (paper feeding) from the paper feeding tray 1 is started at Step S1, and the printing paper is conveyed toward the image forming unit via the paper conveying path 3 (S1). At Step S1, the box paper-discharge rollers 16 are positively rotated by driving the box paper-discharge motor 17 (with a positive rotation).

When jamming occurs during conveyance of the printing paper on the paper conveying path 3, the jamming is detected at Step S2, and the process control goes to Step S3.

The jamming can be detected by using the border sensor 6 or the branch sensor 7. For example, when the printing paper passes through the border sensor 6, the border sensor 6 turns ON (detects the printing paper), and then if the border sensor 6 does not turns OFF within a predetermined time (if the printing paper is still being detected), it is highly possible that jamming has occurred, therefore it is determined as jamming (jamming is detected).

At Step S3, the rotation of the box paper-discharge rollers 16 (conveying rollers) is stopped by stopping driving of the box paper-discharge motor 17, so that conveyance of the printing paper jammed on the paper conveying path 3 (jammed paper) is stopped.

It is then determined at Step S4 whether the border sensor 6 is ON; and then if it is OFF (the printing paper is not being detected), the operation shown in FIG. 3 is terminated. If the border sensor 6 is ON (the printing paper is being detected), it is determined at Step S5 whether the branch sensor 7 is ON; and then if it is OFF, the direction of the switch nail 8 is switched at Step S6.

Figure 4A:
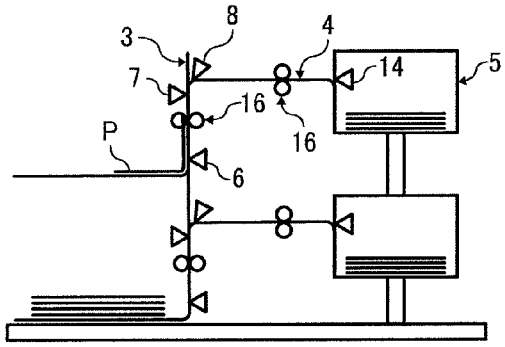
FIGS. 4A to 4E are schematic diagrams for explaining operation after jamming occurs during paper feeding from a paper feeding tray shown in FIG. 2, until jammed paper is discharged into a jammed-paper stock box shown in FIG. 2.
Figure 4B:
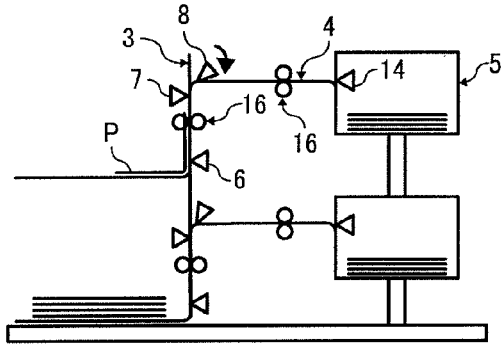

In other words, when the border sensor 6 is ON while the branch sensor 7 is OFF, as shown in FIG. 4A, a jammed paper P is overhanging the border sensor 6, but not overhanging the branch sensor 7; therefore, the switch nail 8 is switched to the direction of the jammed-paper stock box 5 as shown in FIG. 4B so that the jammed paper P is switched to delivery to the jammed-paper stock box 5.

Figure 4C:
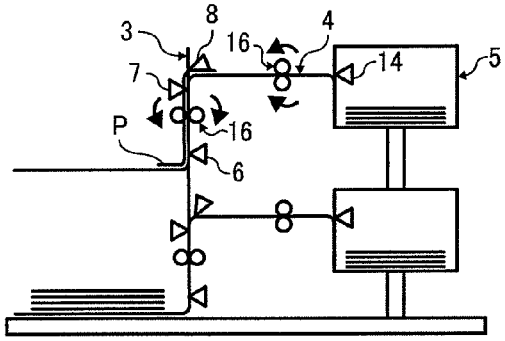

After the switch nail 8 is switched, the box paper-discharge rollers 16 are positively rotated as shown in FIG. 4C by re-driving the box paper-discharge motor 17 (with a positive rotation) at Step S7 shown in FIG. 3, so that the jammed paper P is started to be conveyed toward the jammed-paper stock box 5.

Simultaneously, a warning message (for example, "do not pull out the tray") for avoiding that a user pulls out the paper feeding tray 1 is displayed on the operation unit 113 (in practice, the character display device of the operation unit 113) at Step S8.

Figure 4D:
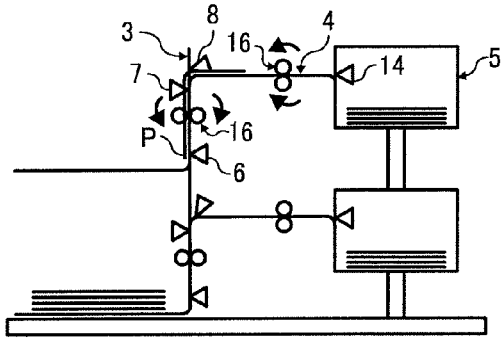

The jammed paper P is then cleared from the border sensor 6 as shown in FIG. 4D; and when it is determined at Step S9 that the border sensor 6 turns OFF, the process control goes to Step S10, and the warning message that has been displayed on the operation unit 113 is deleted.

Figure 4E:
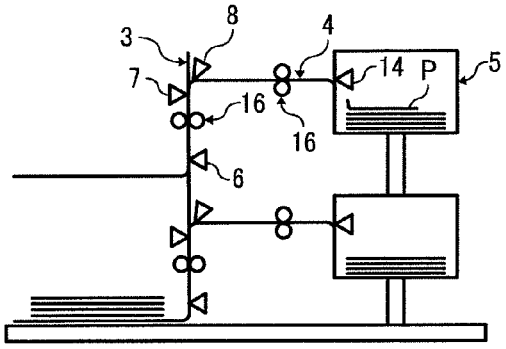

The jammed paper P then passes through the box paper-discharge sensor 14 as shown in FIG. 4E, and when it is determined at Step S11 that the box paper-discharge sensor 14 turns OFF, the process control goes to Step S12, determines that the discharge of the jammed paper P to the jammed-paper stock box 5 is completed, and then terminates the operation shown in FIG. 3.

Figure 5A:
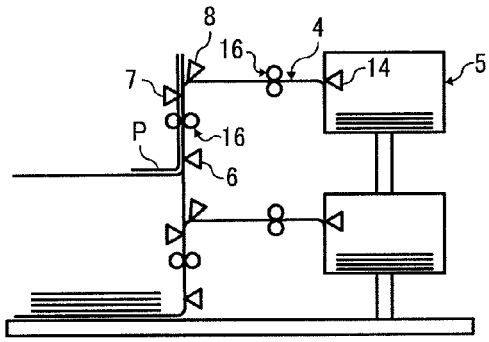
FIGS. 5A to 5F are schematic diagrams for explaining another operation after jamming occurs during paper feeding from the paper feeding tray, until jammed paper is discharged into the jammed-paper stock box.
Figure 5B:
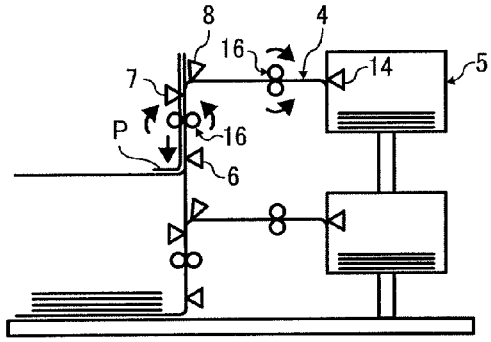

By contrast, if it is determined at Step S5 that the branch sensor 7 is ON, the jammed paper P is overhanging the branch sensor 7 as well as the border sensor 6 as shown in FIG. 5A, therefore, the box paper-discharge rollers 16 are reversely rotated as shown in FIG. 5B by re-driving the box paper-discharge motor 17 (with a reverse rotation) at Step S13, so that conveyance of the jammed paper P is reversed inside the paper conveying path 3.

Simultaneously, a warning message (for example, "do not pull out the tray") for avoiding that a user pulls out the paper feeding tray 1 is displayed on the operation unit 113 (in practice, the character display device of the operation unit 113) at Step S14.

Figure 5C:
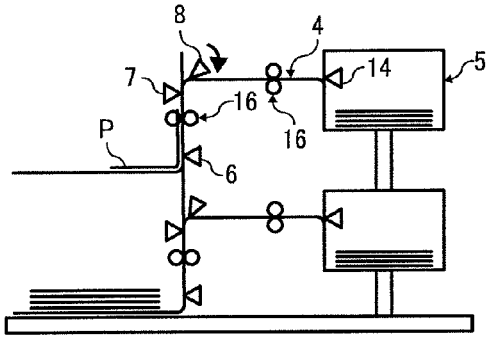

When the jammed paper P is then cleared from the branch sensor 7, it is determined at Step S5 that the branch sensor 7 turns OFF, consequently the direction of the switch nail 8 is switched at Step S6. In other words, the switch nail 8 is switched to the direction of the jammed-paper stock box 5 as shown in FIG. 5C so that the jammed paper P is switched to delivery to the jammed-paper stock box 5.

Figure 5D:
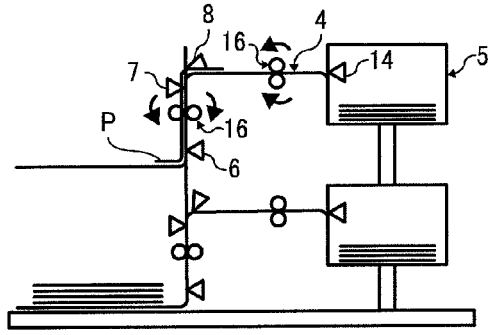

After the direction of the switch nail 8 is switched, the box paper-discharge rollers 16 are positively rotated as shown in FIG. 5D by positively rotating again the box paper-discharge motor 17 at Step S7, so that the jammed paper P is started to be conveyed toward the jammed-paper stock box 5.

Figure 5E:
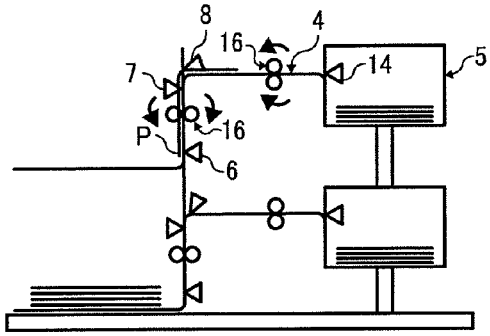

Because the warning message has already been displayed, the processing at Step S8 is skipped; the jammed paper P is then cleared from the border sensor 6 as shown in FIG. 5E; and when it is determined at Step S9 that the border sensor 6 turns OFF, the process control goes to Step S10, and the warning message that has been displayed on the operation unit 113 is deleted.

Figure 5F:
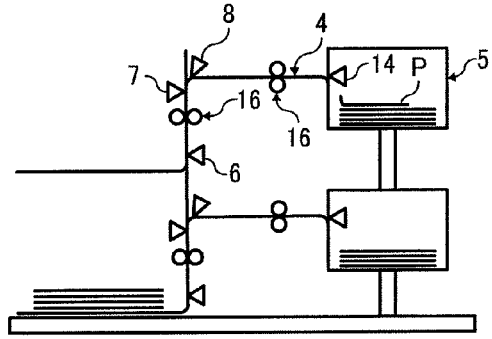

The jammed paper P then passes through the box paper-discharge sensor 14 as shown in FIG. 5F, and when it is determined at Step S11 that the box paper-discharge sensor 14 turns OFF, the process control goes to Step S12, determines that the discharge of the jammed paper P to the jammed-paper stock box 5 is completed, and then terminates the operation shown in FIG. 3.

It can be configured to notify a user not to pull out the paper feeding tray 1 by lighting the pilot lamp on the operation unit 113 at Step S8 or S13, and to turn off the lighting of the pilot lamp at Step S10. Alternatively, it can be configured to cause the tray locking mechanism to lock the paper feeding tray 1 at Step S8 or S13 so that the user cannot pull out the paper feeding tray 1, and to cause the tray locking mechanism to release the lock on the paper feeding tray 1 at Step S10. Furthermore, a plurality of different processing described above which is performed at Steps S8, S10, and S13 can be arbitrarily combined.

Although the operation of discharging jammed paper into the jammed-paper stock box 5 explained above is in a case where jamming occurs during paper feeding from the paper feeding tray 1; if jamming occurs during paper feeding from the paper feeding tray 2, jammed paper can be discharged into the jammed-paper stock box 10 in accordance with a similar operation by using different sensors and rollers.

In this way, when jamming occurs, the image forming apparatus can withdraw jammed paper into the jammed-paper stock box outside the paper conveying path, thereby avoiding a secondary trouble caused by a residual piece of paper left inside the apparatus.

Moreover, effects described in the following (a) to (c) can be obtained:

(a) A possibility that a user pulls out a paper feeding tray before jammed paper is cleared from the border between the paper feeding tray and the apparatus body can be reduced because of a warning indication as described above;

(b) A problem that a user pulls out a paper feeding tray before jammed paper is cleared from the border between the paper feeding tray and the apparatus body can be avoided, because of a lock on a paper feeding tray provided by the tray locking mechanism as described above; and (c) When jamming occurs, jammed paper can be withdrawn to the jammed-paper stock box outside the paper conveying path regardless of the position of the tip of the jammed paper by reversing conveyance of jammed paper and by switching the direction of the switch nail as described above. Accordingly, a secondary trouble caused by a residual piece of paper left in the apparatus can be securely avoided.

A computer program according to the embodiment of the present invention is configured to implement functions as a jam detecting unit, a conveyance control unit, a warning-indication control unit, and a tray-lock control unit, which are relevant to the embodiment of the present invention. The effects as described above can be obtained by causing a CPU to execute the computer program.

The computer program can be initially stored in a storage unit, such as a ROM, a nonvolatile memory (for example, flash ROM, electrically erasable/programmable read only memory (EEPROM)), or an HDD, which is included in the image forming apparatus; and can be alternatively provided by being recorded on a recording medium, such as a compact disk read only memory (CD-ROM), a memory card, a flexible disk, a magneto-optical disk (MO), a compact disk recordable (CD-R), a compact disk rewritable (CD-RW), a digital versatile disk (DVD) +recordable (DVD+R), a DVD+rewritable (DVD+RW), a DVD-R, or a DVD-RW, or a nonvolatile recording medium (memory), such as a DVD-RAM. Each of the procedures described above can be executed by installing the computer program recorded on one of the recording media onto the image forming apparatus and causing the CPU to execute the program, or causing the CPU to read and execute the computer program from one of the recording media.

Furthermore, the computer program can be executed by downloading from an external device that is connected to a network and includes a recording medium that records thereon the computer program, or an external device that is connected to a network and stores the computer program in a storage unit.

According to an aspect of the present invention, when jamming occurs, jammed paper can be withdrawn into the jammed-paper stock box outside the paper conveying path, so that a secondary trouble caused by a residual piece of paper left inside the apparatus can be avoided.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a body;

a paper feeding tray provided in a detachable manner in the body for stacking paper;

an image forming unit that performs image forming on a paper and that is arranged in the body;

a paper conveying path that extends from the paper feeding tray to an image forming unit and feeds a paper from the paper feeding tray to the image forming unit;

a paper discharge tray for stacking paper that has an image formed by the image forming unit;

a paper container for stacking jammed paper;

a branch conveying path that extends from a branching point in the paper conveying path to the paper container;

a first paper sensor that is arranged in the paper conveying path downstream of the paper feeding tray and upstream of the branching point and detects a paper passing through the paper conveying path;

a second paper sensor that is arranged in the paper conveying path downstream of the first paper sensor and upstream of the branching point and detects a paper passing through the paper conveying path;

a switch nail that is arranged at the branching point and configured to switch conveyance paths of a paper between the paper conveying path and the branch conveying path;

a jam detecting unit that detects paper jamming on the paper conveying path; and a switch control unit that controls the switch nail so that the jammed paper is conveyed to the paper container via the branch conveying path after the jam detecting unit detects paper jamming and the first sensor detects the jammed paper while the second sensor does not detect the jammed paper.

2. The image forming apparatus according to claim 1, further comprising a warning unit that outputs a warning to inform a user of a paper jam when the jam detecting unit detects paper jamming and deletes the warning when the first sensor no longer detects the jammed paper.

3. The image forming apparatus according to claim 2, wherein the warning unit includes a pilot lamp that lights when the jam detecting unit detects paper jamming.

4. The image forming apparatus according to claim 2, wherein the warning unit includes a display unit that displays a message when the jam detecting unit detects paper jamming.

5. The image forming apparatus according to claim 1, further comprising:

a tray locking unit that locks the paper feeding tray so that the paper feeding tray cannot be detached from the body; and a tray-lock control unit that causes the tray locking unit to lock the paper feeding tray when the jam detecting unit detects paper jamming, and to release a lock on the paper feeding tray set by the tray locking unit when the first sensor no longer detects the jammed paper.

6. The image forming apparatus according to claim 1, wherein when the jam detecting unit detects paper jamming, and the first sensor and the second sensor detect the jammed paper, the jammed paper is conveyed in a reverse direction until the jammed paper is no longer detected by the second sensor, and the switch control unit controls the switch nail so that the jammed paper is conveyed to the paper container via the branch conveying path.

7. A paper-jam clearing method implemented in an image forming apparatus that includes a body; a paper feeding tray provided in a detachable manner in the body for stacking paper; an image forming unit that performs image forming on a paper and that is arranged in the body; a paper conveying path that extends from the paper feeding tray to an image forming unit and feeds a paper from the paper feeding tray to the image forming unit; a paper discharge tray for stacking paper that has an image formed by the image forming unit; a paper container for stacking jammed paper; a branch conveying path that extends from a branching point in the paper conveying path to the paper container; a first paper sensor that is arranged in the paper conveying path downstream of the paper feeding tray and upstream of the branching point and detects a paper passing through the paper conveying path; a second paper sensor that is arranged in the paper conveying path downstream of the first paper sensor and upstream of the branching point and detects a paper passing through the paper conveying path; a switch nail that is arranged at the branching point and configured to switch conveyance paths of a paper between the paper conveying path and the branch conveying path; and a jam detecting unit that detects paper jamming on the paper conveying path, the paper-jam clearing method comprising:

controlling the switch nail so that the jammed paper is conveyed to the paper container via the branch conveying path after the jam detecting unit detects paper jamming and the first sensor detects the jammed paper while the second sensor does not detect the jammed paper.

8. The paper-jam clearing method according to claim 7, further comprising outputting a warning to inform a user of a paper jam when the jam detecting unit detects paper jamming and stop outputting the warning when the first sensor no longer detects the jammed paper.

9. The paper-jam clearing method according to claim 8, wherein the outputting includes lighting a pilot lamp.

10. The paper-jam clearing method according to claim 8, wherein the outputting includes displaying a message on a display unit.

11. The paper-jam clearing method according to claim 7, further comprising:

locking the paper feeding tray so that the paper feeding tray cannot be detached from the body when the jam detecting unit detects paper jamming; and releasing a lock on the paper feeding tray when the first sensor no longer detects the jammed paper.

12. The paper-jam clearing method according to claim 7, wherein the controlling includes, when the jam detecting unit detects paper jamming and the first sensor and the second sensor detect the jammed paper, conveying the jammed paper in a reverse direction until the jammed paper is no longer detected by the second sensor, and controlling the switch nail so that the jammed paper is conveyed to the paper container via the branch conveying path.

* * * * *